US006701617B2

(12) United States Patent
Li et al.

(10) Patent No.: US 6,701,617 B2
(45) Date of Patent: Mar. 9, 2004

(54) SPIN-FORMING METHOD FOR MAKING CATALYTIC CONVERTER

(75) Inventors: Houliang Li, Novi, MI (US); Joseph Michael Lanzesira, Monroe, MI (US); Earl T. Nelson, Livonia, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 40 days.

(21) Appl. No.: 10/213,693

(22) Filed: Aug. 6, 2002

(65) Prior Publication Data

US 2004/0025341 A1 Feb. 12, 2004

(51) Int. Cl.[7] ..... B23D 15/00

(52) U.S. Cl. ..... 29/890; 29/407.05; 29/418; 29/422; 29/520; 72/83; 72/121

(58) Field of Search ..... 29/890, 407.05, 29/418, 422, 445, 515, 520; 422/180, 177; 72/83, 82, 84, 121, 120

(56) References Cited

U.S. PATENT DOCUMENTS

| | | | |
|---|---|---|---|
| 4,002,433 | A | 1/1977 | Oser |
| 4,565,081 | A | 1/1986 | Massee |
| 5,330,728 | A | 7/1994 | Foster |
| 5,419,876 | A | 5/1995 | Usui et al. |
| 5,482,681 | A | 1/1996 | Sager, Jr. |
| 5,758,532 | A | 6/1998 | Massee |
| 5,775,151 | A | 7/1998 | Massee |
| 5,782,089 | A | 7/1998 | Machida et al. |
| 5,787,584 | A | 8/1998 | Shea et al. |
| 5,901,595 | A | 5/1999 | Massee |
| 6,018,972 | A | 2/2000 | Irie |
| 6,067,833 | A | 5/2000 | Irie |
| 6,086,829 | A | 7/2000 | Shea et al. |
| 6,162,403 | A | 12/2000 | Foster et al. |
| 6,216,512 | B1 | 4/2001 | Irie |
| 6,233,993 | B1 | 5/2001 | Irie |
| D452,694 | S | 1/2002 | Irie |
| 6,381,843 | B1 | 5/2002 | Irie et al. |

*Primary Examiner*—I Cuda-Rosenbaum
(74) *Attorney, Agent, or Firm*—Brinks Hofer Gilson & Lione

(57) ABSTRACT

A method is provided for forming a catalytic converter that includes a catalyst substrate having a noncircular circumference and surrounded by a metal housing. The catalyst substrate is initially measured to determine the radial dimension of the substrate circumference relative to a central axis. The substrate is wrapped in a compressible mat and arranged within a metal tube. The arrangement is subjected to a spin-forming process that forms the metal tube about the catalyst substrate. The spin-forming process includes rotating the metal tube about the substrate axis, while concurrently urging a metal-forming tool against the metal tube. The metal-forming tool is programmed to follow a metal-forming path corresponding to the substrate circumference plus a predetermined radial distance. In this manner, a metal housing is formed having a noncircular circumference corresponding in shape to the catalyst substrate and spaced apart by a uniform insulative layer.

9 Claims, 2 Drawing Sheets

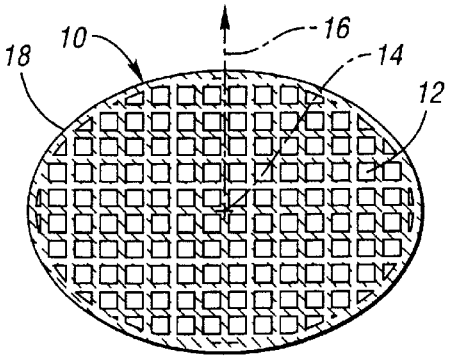
Fig. 1
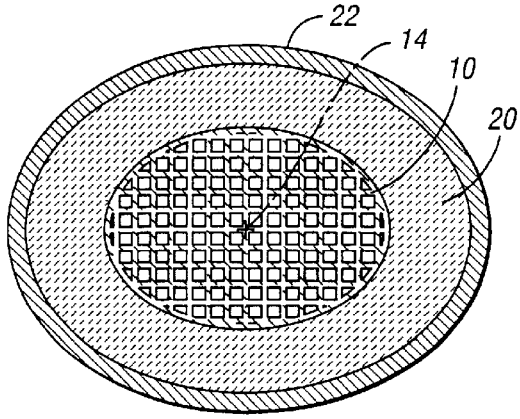
Fig. 3
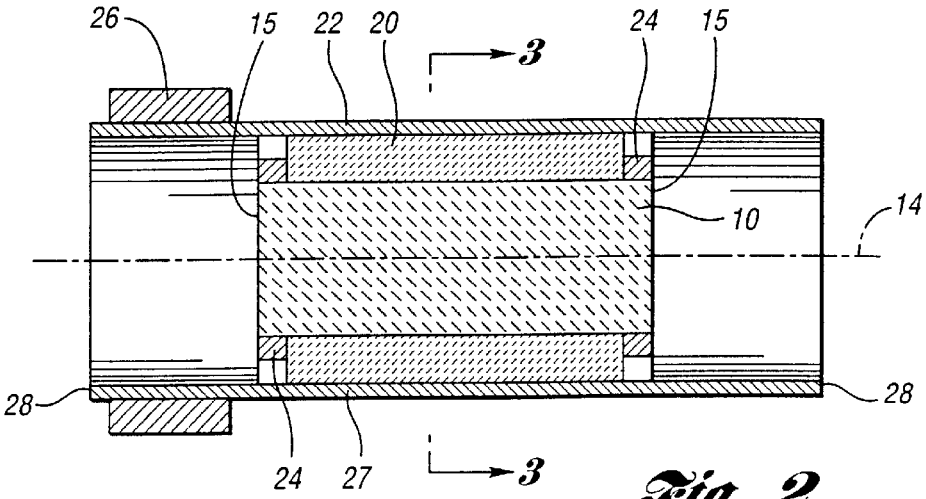
Fig. 2
Fig. 4
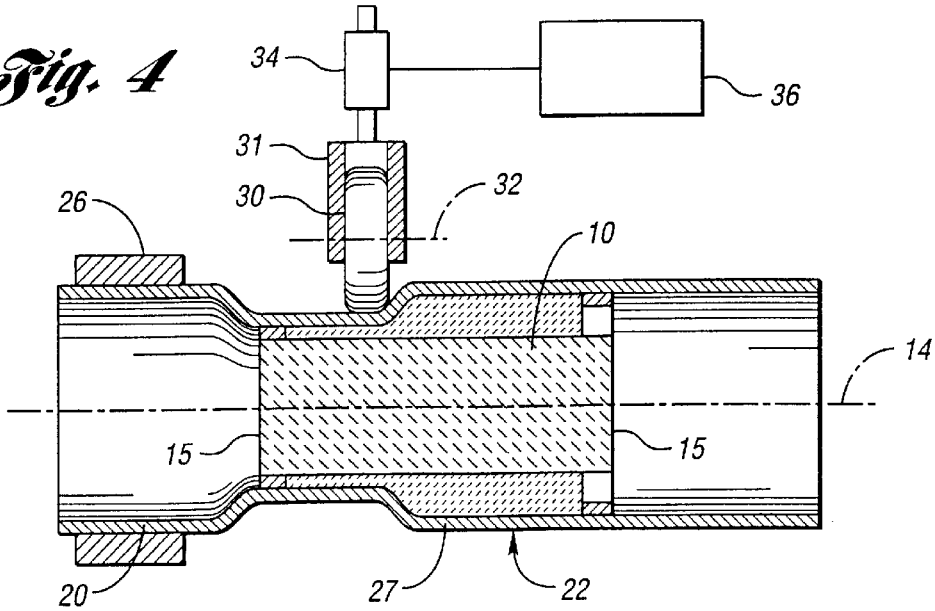

Fig. 5
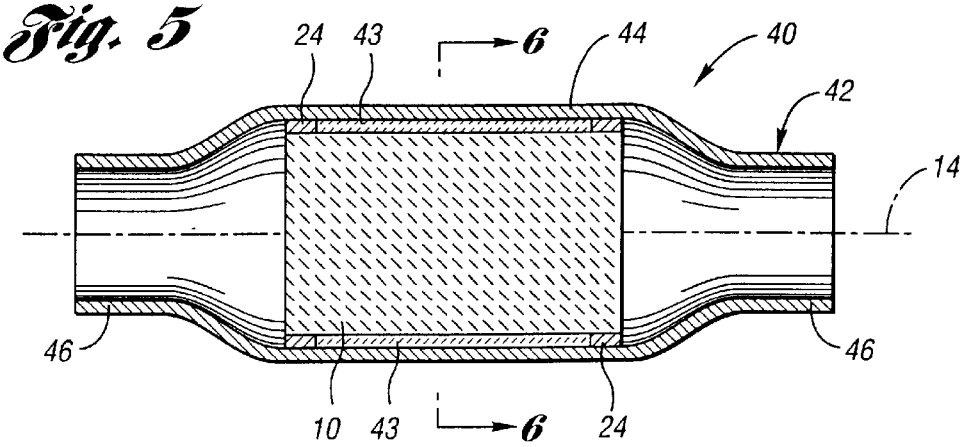
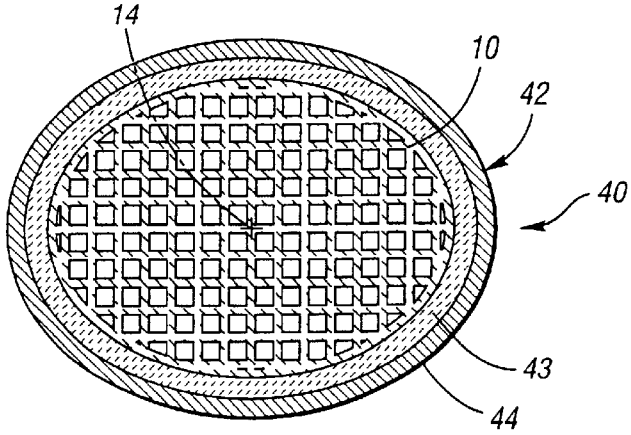
Fig. 6
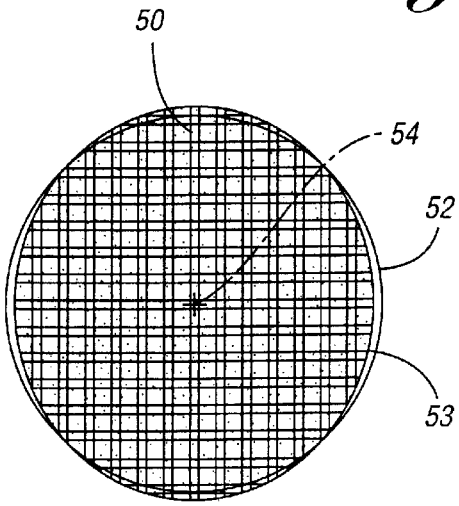
Fig. 7
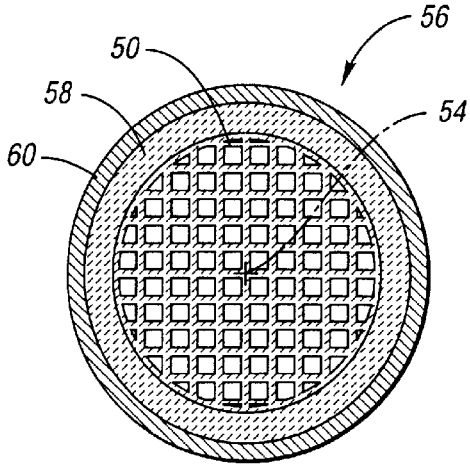
Fig. 8

SPIN-FORMING METHOD FOR MAKING CATALYTIC CONVERTER

TECHNICAL FIELD OF THE INVENTION

This invention relates to a method for manufacturing a catalytic converter by spin-forming a metal tube about a catalyst substrate to form a housing. More particularly, this invention relates to a spin-forming method wherein the catalyst substrate has a noncircular circumference and wherein the metal-forming tool is positioned during spin-forming to form a housing shaped similar to the catalyst substrate and sized greater than the catalyst substrate by a uniform distance.

BACKGROUND OF THE INVENTION

Automotive vehicles are equipped with a catalytic converter for treating exhaust gases to reduce noxious compounds prior to emission into the atmosphere. A typical catalytic converter comprises a catalyst substrate that is formed by extruding and firing a ceramic material and defines a plurality of passages that are coated with catalyst agents for treating exhaust gases caused to flow therethrough. The catalyst substrate is generally cylindrical and is enclosed in a metal housing. A thermally insulative material is interposed between the catalyst substrate and the metal housing to maintain the substrate at an elevated temperature effective for treatment and prevent overheating of the housing.

It has been proposed to manufacture a catalytic converter by spin-forming a metal tube about the catalyst substrate to form the housing. During spin-forming, the catalyst substrate is positioned in the metal tube, and the substrate and tube are rotated about a central axis. The metal forming tool is radially urged against the metal, while advancing axially, to reduce the circumference of the tube. Multiple passes are typically required in order to achieve the desired product size and shape. For each pass, the tool is radially advanced a small distance, so that the diameter is reduced incrementally.

In conventional spin-forming processes, the metal-forming tool is positioned a fixed distance from the axis, and produces a housing having a circular cross section. Thus the process is suited for producing a housing about a cylindrical substrate with a circular cross-section uniformly spaced from the housing. It is desired to produce a catalytic converter having other shapes, which would need to be based upon a substrate having a noncircular cross-section; for example, an oval circumference. Moreover, even for catalyst substrates that are designed to be cylindrical, the radial dimensions of the substrate tends to vary as a result of the extruding and firing of the ceramic material, so that the circumference of the catalyst substrate is not a true circle, but tends to have a radius that varies with direction, a condition referred to as out-of-round. During spin-forming, regions of the substrate having a greater radius than specified may experience higher pressure from the metal-forming tool, which may cause breakage of the fragile substrate. Furthermore, variations in the radius may result in a non-uniform thickness of insulation between the substrate and the housing.

Therefore, a need exists for a method of forming a catalytic converter by spin-forming that is suited for forming a metal housing about a catalyst substrate having a noncircular circumference, either by design or as a result of deviations that occur during processing of the ceramic. It is desired that the housing formed by spin-forming be spaced apart form the noncircular substrate by a uniform radial distance, such that a uniform layer of insulative material is disposed between the housing and substrate.

BRIEF SUMMARY OF THE INVENTION

In accordance with this invention, a method is provided for forming a catalytic converter that includes a catalyst substrate having a noncircular circumference. The catalyst substrate is measured to determine the radial dimension of the noncircular circumference relative to an axis. The catalyst substrate is wrapped in a compressible mat and arranged in a metal tube. The arrangement is subjected to a spin-forming process that forms the metal tube about the catalyst substrate into a metal housing. The spin-forming process includes rotating the metal tube about the substrate axis and concurrently radially urging a metal-forming tool against the tube. In accordance with this invention, the metal-forming tool is programmed to follow a metal-forming path corresponding to the substrate circumference plus a predetermined radial distance. In this manner, a metal housing for the catalytic converter is produced having a noncircular circumference that corresponds in shape to the substrate and is spaced apart therefrom by an insulative layer.

BRIEF DESCRIPTION OF THE DRAWINGS

The present invention will be further illustrated with reference to the accompanying drawings wherein:

FIG. 1 is a cross-section of a catalyst substrate for forming a catalytic converter in accordance with a preferred embodiment of this invention;

FIG. 2 is a cross-sectional view showing an arrangement of components for spin-forming a catalytic converter in accordance with a preferred embodiment of this invention;

FIG. 3 is a cross-sectional view of the arrangement in FIG. 2 taken along lines 3—3 and looking in the direction of the arrows;

FIG. 4 is a cross-sectional view of the arrangement in FIG. 2 showing the components during spin-forming of a catalytic converter in accordance with this invention;

FIG. 5 is a cross-sectional view showing a catalytic converter spin-formed in accordance with this invention;

FIG. 6 is a cross-sectional view of the catalytic converter in FIG. 5 taken along the lines 6—6 in the direction of the arrows;

FIG. 7 is a cross sectional view of a catalyst substrate that is out-of-round for forming a catalytic converter in accordance with an alternate embodiment of this invention; and FIG. 8 is a cross-sectional view of a catalytic converter comprising the catalyst substrate in FIG. 7 and spin-formed in accordance with an alternate embodiment of this invention.

DETAILED DESCRIPTION OF THE INVENTION

In accordance with a preferred embodiment of this invention, referring briefly to FIGS. 5 and 6, a method is provided for manufacturing a catalytic converter 40 comprising a ceramic catalyst substrate 10 having an oval circumference and enclosed within a metal housing 42 spaced apart by a layer 43 of insulative material. The method uses a spin-forming process, carried out using a metal-forming tool 30 in FIG. 4, to form the metal housing having a similar oval shape to the substrate and sized greater than the substrate to provide a uniform layer of insulation therebetween.

Referring to FIG. 1, in this embodiment, substrate 10 has an axis 14 and an outer surface 18 characterized by an oval circumference. Substrate 10 comprises end faces in FIG. 2 and defines a plurality of axial passages between the ends, of which only a few are depicted. The substrate is formed by extruding and firing a ceramic material. During use, exhaust gas from an internal combustion engine flows through passages 12 and is treated by catalytic agents applied on the passage surfaces.

Prior to assembly, outer surface 18 of substrate 10 is mapped to determine the radial dimensions relative to axis 14. For this purpose, the dimensions are measured between axis 14 and a series of points at the surface. The points are located in planes perpendicular to the axis and equidistantly spaced about the circumference. Thus, each point is readily identified by an angular displacement relative to a reference direction 16 and an axial distance relative to an end 15 of the substrate. Measurements may be made by any suitable technique that provides an accurate distance of a surface relative to a predetermined reference point, that is, axis 14. In a preferred embodiment, a laser gauge is utilized that locates the surface without contact with the thin ceramic. Alternately, a mechanical instrument that contacts the surface may be employed. The measurements are correlated with the angle from reference direction 16 and the axial distance from an end 15 and stored in a computer memory.

Following measurement of the surface, substrate 10 is wrapped in a compressible mat 20 and inserted into a metal tube 22, as shown in FIGS. 2 and 3. Mat 20 is formed of ceramic fibers and provides thermal insulation of the substrate in the product converter. Annular seals 24 are disposed about the substrate near the ends to restrict gas flow through the mat.

The resulting wrapped substrate is coaxially inserted into metal tube 22. Tube 22 includes a midsection 27 about substrate 10 and end sections 28 that extend axially beyond midsection 27. In the preferred embodiment, tube 22 has an oval cross-sectional shape similar to the substrate and is suitably sized to permit the wrapped pre-assembly to be readily inserted.

Referring to FIG. 4, the pre-assembly of substrate 10, mat 20 and metal tube 22 is subjected to a spin-forming process to reduce the tube radius of midsection 27 to secure the substrate within the tube and form the catalytic converter. For this purpose, the pre-assembly is mounted onto a chuck 26 that spins tube 22 to rotate the tube about axis 14. While the tube is rotated, a metal-forming tool 30 is radially urged against the outer surface of the metal tube along midsection 27. In a preferred embodiment, tool 30 is a roller mounted on a yoke 31 to rotate about an axis 32 parallel to axis 14. As roller 30 is radially urged against the metal tube, the roller is concurrently advanced axially to progressively reduce the tube diameter. As the diameter is reduced, compressible mat 20 is compressed about substrate 10. In accordance with this invention, roller 30 is connected to an actuator 34, such as a hydraulic actuator, that positions the roller relative to axis 14, in response to a signal from a computer control module 36. A suitable spin-forming machine is commercially available from M&M Metal Forming Machinery, Inc., under the trade designation Spin Shrinking Machine Model SSM 350 TT.

In accordance with this invention, the computer control module determines the position of roller 30 based upon the radial dimensions of substrate 10 measured prior to assembly within the tube. As the tube spins about the axis, roller 30 traverses the metal tube in a plane perpendicular to the axis. The computer control module calculates desired radial dimensions for the tube circumference in the plane by adding a predetermined radial distance to the tube radial dimensions in the plane. Extrapolation is used to calculate dimensions of the substrate in planes other that those for which measured values are available. The computer control module then positions the metal-forming roller to follow a path corresponding to the desired housing dimensions.

In the final axial pass, tool 30 is positioned a radial distance equal to the total of the substrate dimensions, the desired thickness of insulation layer 43 and the thickness of housing 42. In this manner, the method of this invention produces a housing having an outer surface corresponding in shape to the substrate and spaced apart by a uniform distance. Spin-forming may be carried out in a single axial pass of tool 30. Alternately, multiple passes may be used to incrementally reduce the dimensions of the tube. In a process employing multiple passes, the distance added to the substrate dimensions is preferably chosen to reduce the dimensions of the tube a selected amount during each pass until the desired final size is achieved.

Following spin-forming of midsection 27 about the substrate 10, end sections 28 are formed into the desired size and shape of the inlet and outlet for the catalytic converter. This is preferably accomplished by spin-forming in a manner similar to the process utilized for forming the midsection. The product catalytic converter 40 is shown in FIGS. 5 and 6. Converter 40 comprises a metal housing 42 that is formed by spin-forming in accordance with this invention. Housing 42 includes a midsection 44 about substrate 10, with insulative layer 43 and seals 24 compressed therebetween. Housing 42 also includes end portions 46 that form the inlet and outlet to the catalytic converter. As can be seen in FIG. 6, regulation of the metal-forming tool during spin-forming in accordance with this invention produces a housing comprising a midsection 44 having a shape corresponding to substrate 10 and spaced apart by a substantially uniform distance. Moreover, compression of mat 20 between midsection 44 and substrate 10 produces layer 43 having a substantially uniform thickness.

Therefore, this invention provides a method for forming a midsection of a catalytic converter housing about a substrate having a noncircular circumference. The metal housing conforms in shape to the substrate and is uniformly sized about the substrate. Moreover, the insulative mat is uniformly compressed about the substrate to provide a uniform density within the housing midsection.

In the embodiment shown in FIGS. 1–6, a method of this invention was utilized in spin-forming a housing about a substrate having an oval circumference. The method may be applied to catalyst substrates having other suitable noncircular shapes, including a race track circumference or a nonsymmetrical shape. In an alternate embodiment, a housing is formed about a catalyst substrate that is designed to be cylindrical but has a circumference that is noncircular as a result of variations that occur during extruding and firing of the ceramic, commonly referred to as out-of-round. Referring to FIG. 7, there is shown an out-of-round catalyst substrate 50 having a circumference 53 that deviates from a circle 52. In accordance with this invention, a housing may be spin-formed about substrate 50 to correspond in shape to the substrate despite the out-of-round deviations. This is accomplished by mapping circumference 53 of the substrate prior to spin-forming to determine the radial dimensions relative to an axis 54, which corresponds to the central axis of the substrate as designed. The substrate is wrapped in a compressible mat and coaxially inserted within a metal tube.

Thereafter, the substrate and metal tube are spun about a center axis 54 while forming the metal tube with a metal-forming roller. During forming, a control module adjusts the position of the roller to follow a path corresponding to the actual radial dimensions of the substrate plus a predetermined distance. The product catalytic converter 56 is shown in FIG. 8 and comprises substrate 50 surrounded by a layer 58 of insulative material and enclosed within a midsection of a metal housing 60. The housing midsection is out-of-round to correspond in shape to the out-of-round dimensions of substrate 50. In addition, the housing is sized greater than the substrate by predetermined distance to provide a uniform layer 50 of insulation therebetween.

While this invention has been described in terms of certain embodiments thereof, it is not intended to be limited to the described embodiments, but only to the extent set forth in the claims that follow.

What is claimed is:

1. A method for forming a catalytic converter comprising a catalyst substrate having a substrate axis and a noncircular circumference about the substrate axis, an insulative layer about the catalyst substrate, and a metal housing disposed about the insulative layer, said method comprising:

measuring the catalyst substrate to determine radial dimensions of the noncircular circumference relative to the substrate axis, arranging the catalyst substrate and a compressible mat within a metal tube such that the compressible mat is interposed between the metal tube and the catalyst substrate, and spin-forming the metal tube about the catalyst substrate to form the metal housing and to compress the compressible mat between the catalyst substrate and the metal housing to form the insulative layer, said spin-forming comprising rotating the metal tube about the substrate axis and concurrently radially urging a metal-forming tool against the metal tube, said spin-forming further comprising programming the metal-forming tool to follow a metal-forming path corresponding to the radial dimensions of the substrate circumference plus a predetermined radial distance, thereby forming a metal housing having a noncircular circumference corresponding in shape to the substrate and spaced apart therefrom by the insulative layer.

2. A method according to claim 1 wherein the substrate has an oval circumference.

3. A method according to claim 1 wherein the step of spin-forming further comprises axially advancing the metal-forming tool while radially urging the metal-forming tool against the metal tube to progressively form the metal tube.

4. A method according to claim 1 wherein the metal-forming tool is a roller rotatable about a roller axis parallel to the substrate axis.

5. A method according to claim 1 wherein the catalyst substrate is an out-of-round substrate having radial dimensions about the substrate axis that vary depending upon direction.

6. A method for forming a catalytic converter comprising a catalyst substrate, an insulative layer surrounding the catalyst substrate, and a metal housing having a housing midsection surrounding the catalyst substrate and the insulative layer, said method comprising:

providing a catalyst substrate having a substrate axis and a noncircular substrate circumference about the substrate axis, measuring the noncircular substrate circumference, said measuring comprising selecting a reference direction relative to the substrate axis and determining the radial dimensions to the circumference as a function of angular displacement relative to the reference direction, wrapping a compressible mat about the catalyst substrate to from a wrapped substrate, providing a metal tube comprising a tube midsection having a tube axis, coaxially inserting the wrapped substrate into the midsection of the metal tube, and spin-forming the metal tube about the wrapped substrate to form the housing midsection, said spin-forming comprising rotating the metal tube about the tube axis, and radially urging while axially advancing a metal-forming roller against the metal tube to reduce the radial dimensions and to compress the compressible mat to form the insulative layer, said spin-forming further comprising positioning the metal-forming roller a radial distance relative to the substrate axis and adjusting the radial distance of the metal-forming roller as a function of the angular displacement relative to the reference direction, such that the metal-forming roller is positioned a radial distance relative to the substrate axis equal to the radial dimension of the substrate plus a predetermined radial dimension, whereby the metal-forming roller forms the housing midsection having a shape corresponding to the noncircular circumference of the catalyst substrate and spaced apart therefrom by an insulative layer having substantially uniform thickness.

7. A method according to claim 6 wherein the metal-forming roller is rotatable about a roller axis parallel to the substrate axis.

8. A method according to claim 6 wherein the catalyst substrate is a out-of round cylindrical substrate.

9. A method according to claim 6 wherein the substrate has an oval circumference.

* * * * *